US010527052B2

(12) United States Patent
Cailotto et al.

(10) Patent No.: US 10,527,052 B2
(45) Date of Patent: Jan. 7, 2020

(54) CENTRIFUGAL PUMP OF THE SUBMERSED OR SUBMERSIBLE TYPE

(71) Applicant: DAB PUMPS S.P.A., Mestrino (IT)

(72) Inventors: Pietro Cailotto, Trissino (IT); Francesco Sinico, Montecchio Maggiore (IT)

(73) Assignee: DAB PUMPS S.P.A., Mestrino (IT)

( * ) Notice: Subject to any disclaimer, the term of this patent is extended or adjusted under 35 U.S.C. 154(b) by 286 days.

(21) Appl. No.: 15/325,260

(22) PCT Filed: Jul. 7, 2015

(86) PCT No.: PCT/EP2015/065472
§ 371 (c)(1),
(2) Date: Jan. 10, 2017

(87) PCT Pub. No.: WO2016/005387
PCT Pub. Date: Jan. 14, 2016

(65) Prior Publication Data

US 2017/0167499 A1 Jun. 15, 2017

(30) Foreign Application Priority Data

Jul. 10, 2014 (IT) ..... PD2014A0183

(51) Int. Cl.

| | |
|---|---|
| ***F04D 29/08*** | (2006.01) |
| ***F04D 1/00*** | (2006.01) |
| ***F04D 13/08*** | (2006.01) |
| ***F04D 29/043*** | (2006.01) |
| ***F04D 29/22*** | (2006.01) |
| ***F04D 29/42*** | (2006.01) |

(Continued)

(52) U.S. Cl.
CPC ..... *F04D 29/086* (2013.01); *F04D 1/00* (2013.01); *F04D 13/086* (2013.01);
(Continued)

(58) Field of Classification Search
CPC .. F04D 29/086; F04D 29/043; F04D 29/2288; F04D 29/22; F04D 29/426;
(Continued)

(56) References Cited

U.S. PATENT DOCUMENTS 2,002,907 A 5/1935 Sessions
2,217,746 A 10/1940 Hawley, Jr.
(Continued)

FOREIGN PATENT DOCUMENTS

CN 201013653 Y 1/2008
CN 101603541 A 12/2009
(Continued)

OTHER PUBLICATIONS

International Search Report dated Aug. 11, 2015 re: Application No. PCT/EP2015/065472; pp. 1-4; citing: U.S. Pat. No. 2,217,746 A, U.S. Pat. No. 5,336,064 A, U.S. Pat. No. 2,002,907 A, GB 381 508 A, DE 26 18 951 A1 and DK 87 123 C.
(Continued)

*Primary Examiner* — Jacob M Amick
*Assistant Examiner* — Charles Brauch
(74) *Attorney, Agent, or Firm* — Cantor Colburn LLP

(57) ABSTRACT

A centrifugal pump, of the submersed or submersible type, includes a hydraulic part, with a hollow body inside which there is at least one impeller, a motor enclosed within a motor casing that isolates the motor from the pumping liquid, adapted to drive the impeller in rotation via a rotation transmission shaft. The centrifugal pump further includes an open compartment that spaces the motor casing from the hollow body that contains the at least one impeller and hydraulic sealing elements between the open compartment and the motor casing.

9 Claims, 7 Drawing Sheets

(51) Int. Cl.
*F04D 29/10* (2006.01)
*F04D 29/12* (2006.01)

(52) U.S. Cl.
CPC ..... *F04D 29/043* (2013.01); *F04D 29/22* (2013.01); *F04D 29/2288* (2013.01); *F04D 29/426* (2013.01); *F04D 13/08* (2013.01); *F04D 29/106* (2013.01); *F04D 29/126* (2013.01); *F05D 2260/6022* (2013.01)

(58) Field of Classification Search
CPC ..... F04D 13/086; F04D 1/00; F04D 13/08; F04D 29/126; F04D 29/106; F05D 2260/6022
See application file for complete search history.

(56) References Cited

U.S. PATENT DOCUMENTS 5,336,064 A * 8/1994 Lamers ..... F04D 13/0653 417/423.14
2013/0108411 A1* 5/2013 Ciotola ..... B02C 18/0092 415/1

FOREIGN PATENT DOCUMENTS

| | | | |
|---|---|---|---|
| CN | 102979735 | A | 3/2013 |
| CN | 202867268 | U | 4/2013 |
| CN | 203130532 | U | 8/2013 |
| CN | 103307016 | A | 9/2013 |
| CN | 203500044 | U | 3/2014 |
| CN | 203584838 | U | 5/2014 |
| DE | 2618951 | A1 | 11/1976 |
| DK | 87123 | C | 4/1959 |
| GB | 381508 | A | 10/1932 |

OTHER PUBLICATIONS

Written Opinion dated Aug. 11, 2015 re: Application No. PCT/EP2015/065472; pp. 1-6; citing: U.S. Pat. No. 2,217,746 A, U.S. Pat. No. 5,336,064 A, and U.S. Pat. No. 2,002,907.

* cited by examiner

CENTRIFUGAL PUMP OF THE SUBMERSED OR SUBMERSIBLE TYPE

TECHNICAL FIELD

The present disclosure relates to a centrifugal pump of the submersed or submersible type.

BACKGROUND

Conventional centrifugal pumps are composed substantially of a hydraulic part comprising a hollow body provided with suction and delivery ducts, containing one or more impellers intercalated by diffusers and keyed on the transmission shaft of an electric motor enclosed in a motor casing that isolates it from the pumping liquid and keeps it dry.

The electric motor must be further isolated from the liquids at the passage of the shaft for transmitting rotation to the impellers, ensuring the hydraulic seal between the liquid pumping region and the dry region of the motor.

For this purpose, mechanical seals are in widespread use which are to be mounted on the shaft to seal its passage to the impellers, of the single or double type and optionally of the cartridge type, fitted directly on the rotation transmission shaft, inside a sealing chamber that contains lubricant, in order to ensure correct lubrication among the parts that compose the seal, and is interposed between the motor and the pump body so as to surround the rotation shaft.

Submersed pumps and submersible pumps are particular types of pumps that belong to the centrifugal group.

In particular, the expression "submersed pumps" designates the type of pumps, usually having a vertical axis, designed to work underwater. Typical submersed pumps are well pumps, built to work at depth.

The expression "submersible pumps" instead designates pumps, also having a vertical axis, designed to be installed directly in the water on the bottom of a collection basin. Usually, these pumps work with the motor above the water level, but the electric motor and the coupling to the hydraulic part must be perfectly watertight, so that the centrifugal pump may work also submerged, and thus is submersible, if the water level rises in the collection basin. Submersible pumps are widely used in the lifting systems of sewers, in the draining of cellars, excavations and construction sites and in the transport of wastewater, since they are conceived to work with water full of suspended materials.

For these types of pumps, an optimum hydraulic seal is therefore fundamental to avoid compromising its functionality; however, the cited solutions are not devoid of drawbacks, such as, above all, the reliability of the system over time.

In fact, especially in the case of centrifugal pumps of the submersed type or of the submersible type, the seals are subject to wear over time and, due to the hydraulic pressure at which they work, let the liquid being pumped leak into the motor or into the lubricant chamber and then from there into the motor.

Moreover, these types of submersed pump include shredding pumps, typically for wastewater, i.e., provided with a shredder keyed on the rotation transmission shaft. The shredder is arranged in the lower region of the hydraulic part, where there is also an opening from which the liquid to be pumped is drawn. When the centrifugal pump is powered up, the shredder also is activated and, during the shredding of solid bodies, generates vibrations that affect the motor and particularly the bearings keyed on the rotation transmission shaft. These vibrations also put at risk the functionality of the mechanical seal, the parts of which tend to mutually lose alignment, allowing liquid to leak toward the motor. The longer the portion of shaft comprised between the shredder and the motor, the more the vibrations affect the latter.

Still, this type of centrifugal pump can be installed in lifting stations, in which sediments often form. The solid substances tend to compact over time, reducing the useful volume of the tanks and often clogging the pump. Their removal requires a targeted intervention that entails a prolonged and expensive stop of the pumping system. In order to facilitate the good operation of the centrifugal pump, operations for fluidizing the liquid to be pumped are therefore necessary and are often obtained by installing an agitator upstream of the pump body.

SUMMARY

The aim of the present disclosure is to devise a centrifugal pump, of the submersed or submersible type, that is capable of ensuring over time the hydraulic seal between the liquid pumping region and the dry region of the motor at the shaft for transmitting rotation to the impellers, preventing any leakages of liquid to be pumped from reaching the motor.

Within this aim, the disclosure devises a centrifugal pump with increased lifespan, eliminating the risk of damage due to the passage of liquids toward the motor of said pump.

The disclosure further devises a centrifugal pump capable of achieving the aim cited above with a solution that is structurally simple and can be produced at low costs.

The disclosure also provides a centrifugal pump having a longer life also in case the centrifugal pump is provided with a shredder.

The disclosure further provides a centrifugal pump which ensures the correct fluidizing of the liquid to be drawn without the use of adapted devices to be installed upstream of the centrifugal pump.

These advantages are achieved by providing a centrifugal pump, of the submersed or submersible type, comprising a hydraulic part, with a hollow body inside which there is at least one impeller, a motor enclosed within a motor casing that isolates it from the pumping liquid, adapted to drive said impeller in rotation by means of a rotation transmission shaft, said centrifugal pump wherein the pump comprises an open compartment that spaces said motor casing from said hollow body that contains said at least one impeller and hydraulic sealing means between said open compartment and said motor casing.

BRIEF DESCRIPTION OF THE DRAWINGS

Further characteristics and advantages of the disclosure will become better apparent from the description of preferred but not exclusive embodiments of the centrifugal pump according to the disclosure, illustrated by way of non-limiting example in the accompanying drawings, wherein.

DETAILED DESCRIPTION OF THE DRAWINGS

Figure 2:
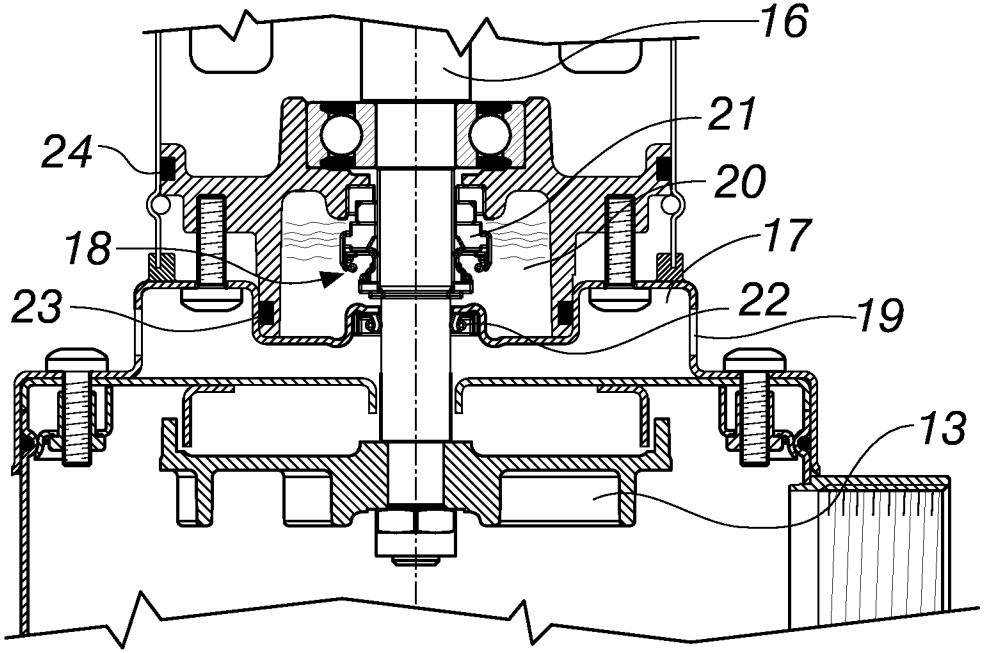
FIG. 2 is an enlarged-scale view of the centrifugal pump of FIG. 1.
Figure 1:
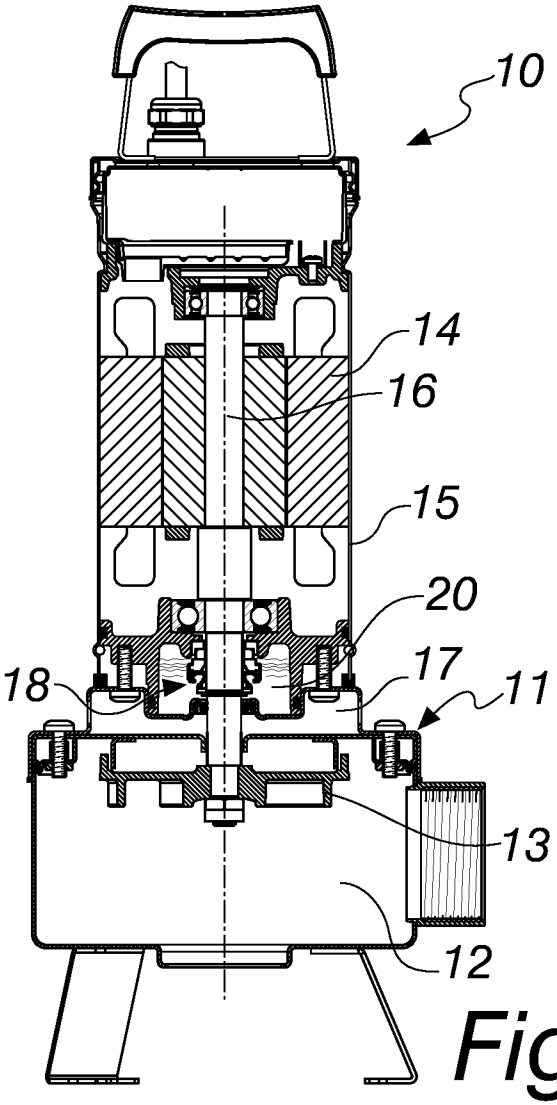
FIG. 1 is a sectional view of a first embodiment of a centrifugal pump according to the disclosure.

With reference to FIGS. 1 and 2, the centrifugal pump according to the disclosure is generally designated in its first embodiment by the reference numeral 10.

The pump is of the submersible type and comprises a hydraulic part 11, with a hollow body 12 inside which there is an impeller 13, a motor 14, enclosed within a motor casing 15 that isolates it from the pumping liquid, adapted to drive the impeller 13 in rotation by means of a rotation transmission shaft 16 that substantially passes through the centrifugal pump 10 lengthwise, connecting the hydraulic part 11 to the motor 14.

The centrifugal pump 10 also comprises an open compartment 17 that spaces the motor casing 15 from the hollow body 12 that contains the impeller 13 and hydraulic sealing means 18 between the open compartment 17 and the motor casing 15. The latter comprises, besides the hollow body 12, also an open compartment 17. FIG. 1 shows the centrifugal pump 10 cross-sectioned at the lateral openings 19 of the open compartment 17.

The details are more clearly visible in the enlarged-scale view of FIG. 2.

In particular, the enlarged-scale view allows to note that the hydraulic sealing means 18 comprise a sealing chamber 20, interposed between the open compartment 17 and the motor casing 15, with a single mechanical seal 21 inside it, and comprise a sealing ring 22. The mechanical seal 21 and the sealing ring 22 are conveniently installed on the rotation transmission shaft 16 so as to surround it.

More in particular, the mechanical seal 21 is installed on the motor side inside the sealing chamber 20, while the sealing ring 22 is installed outside the sealing chamber 20, between said chamber and the open compartment 17.

The seal is also ensured by a first O-ring gasket 23 and a second O-ring gasket 24, which isolate the external structure of the sealing chamber 20 respectively on the hydraulic side and on the motor side.

Figure 4:
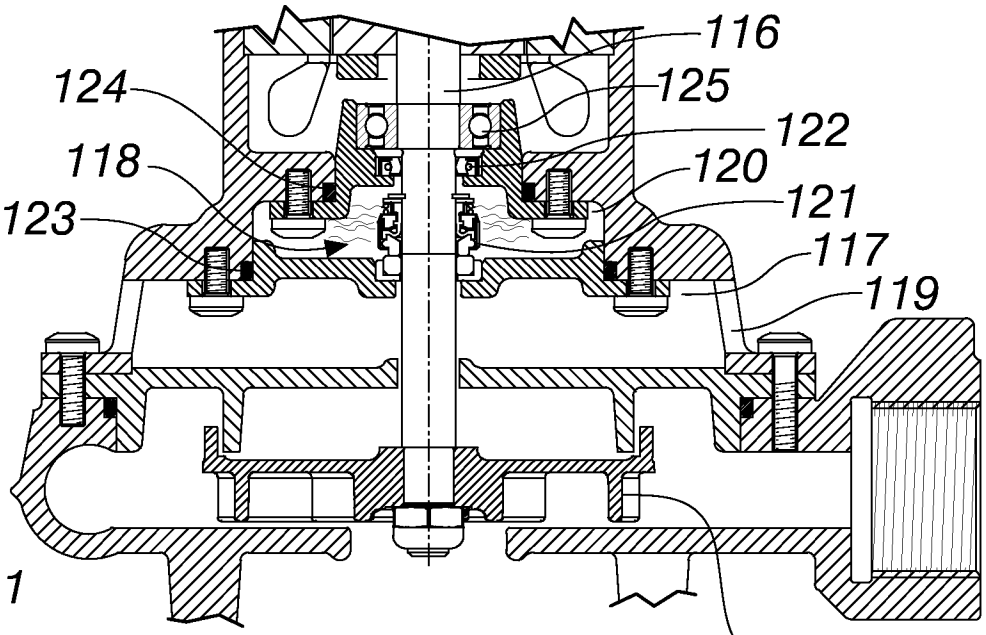
FIG. 4 is an enlarged-scale view of the centrifugal pump of FIG. 3.
Figure 3:
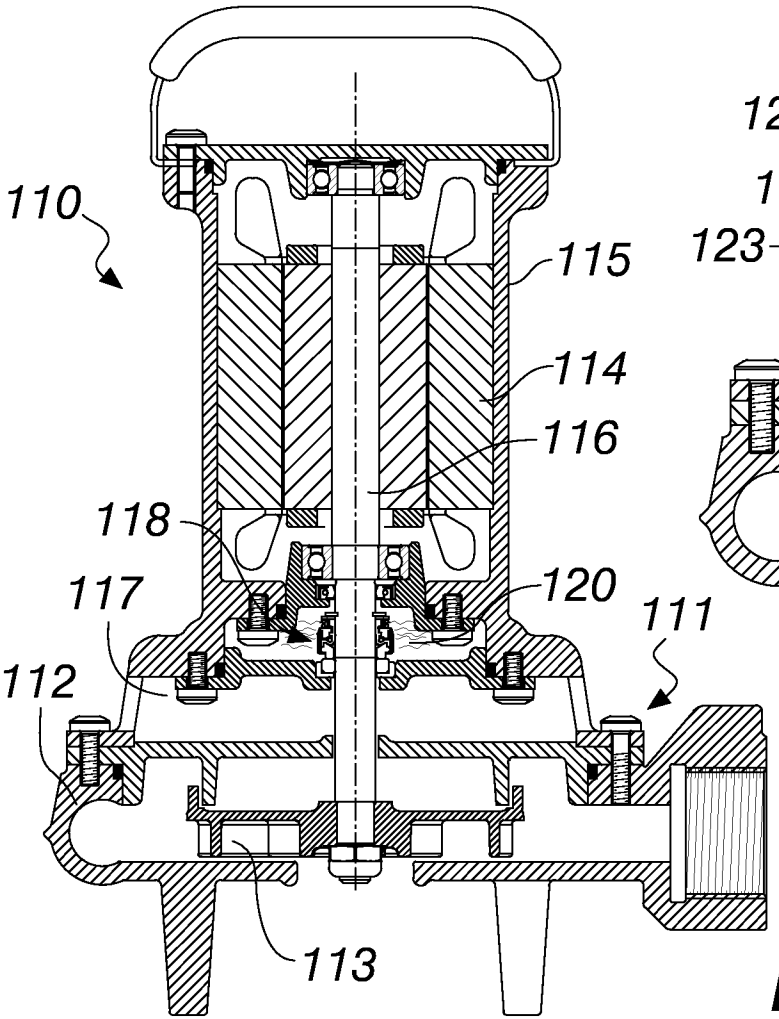
FIG. 3 is a sectional view of a second embodiment of the centrifugal pump according to the disclosure.

The second embodiment of the centrifugal pump is shown in FIG. 3, in which it is generally designated by the reference numeral 110, and an enlarged portion thereof is shown in FIG. 4.

The pump is of the submersible type designed for draining.

The centrifugal pump 110 comprises a hydraulic part 111 with a hollow body 112, inside which there is an impeller 113 turned by a motor 114, enclosed within a motor casing 115 that isolates it from the pumping liquid, by means of a rotation transmission shaft 116, on which the impeller 113 is keyed.

In this embodiment, suction occurs from below and for this reason in the illustration the hollow body 112 is conveniently open from below.

The centrifugal pump 110 comprises, moreover, an open compartment 117 which, similarly to what was described for the previously described embodiment, spaces the motor casing 115 from the hollow body 112 that contains the impeller 113 and also comprises hydraulic sealing means 118 between the open compartment 117 and the motor casing 115.

In FIG. 3 and in the corresponding enlarged-scale view of FIG. 4 the centrifugal pump 110 is shown in cross-section at the lateral openings 119 of the open compartment 117.

The hydraulic sealing means 118 comprise a sealing chamber 120, interposed between the open compartment 117 and the motor casing 115, with a single mechanical seal 121 inside it, and also comprise a sealing ring 122. The mechanical seal 121 and the sealing ring 122 are conveniently installed on the rotation transmission shaft 116 so as to surround it.

The mechanical seal 121 is installed, in this embodiment, on the hydraulic side inside the sealing chamber 120, while the sealing ring 122 is installed on the motor side, outside the sealing chamber 120, substantially between the latter and the motor 114, particularly before the bearing 125.

For sealing there are also a first O-ring gasket 123 and a second O-ring gasket 124, which isolate the external structure of the sealing chamber 120 respectively on the hydraulic side and on the motor side.

Figure 6:
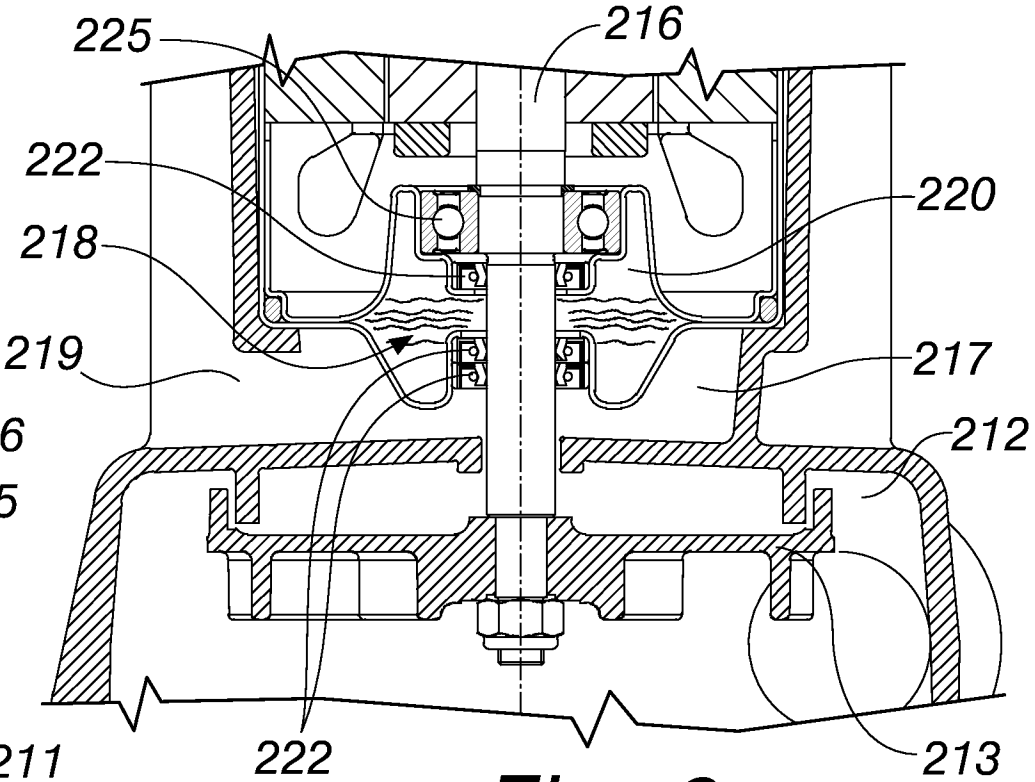
FIG. 6 is an enlarged-scale view of the centrifugal pump of FIG. 5.
Figure 5:
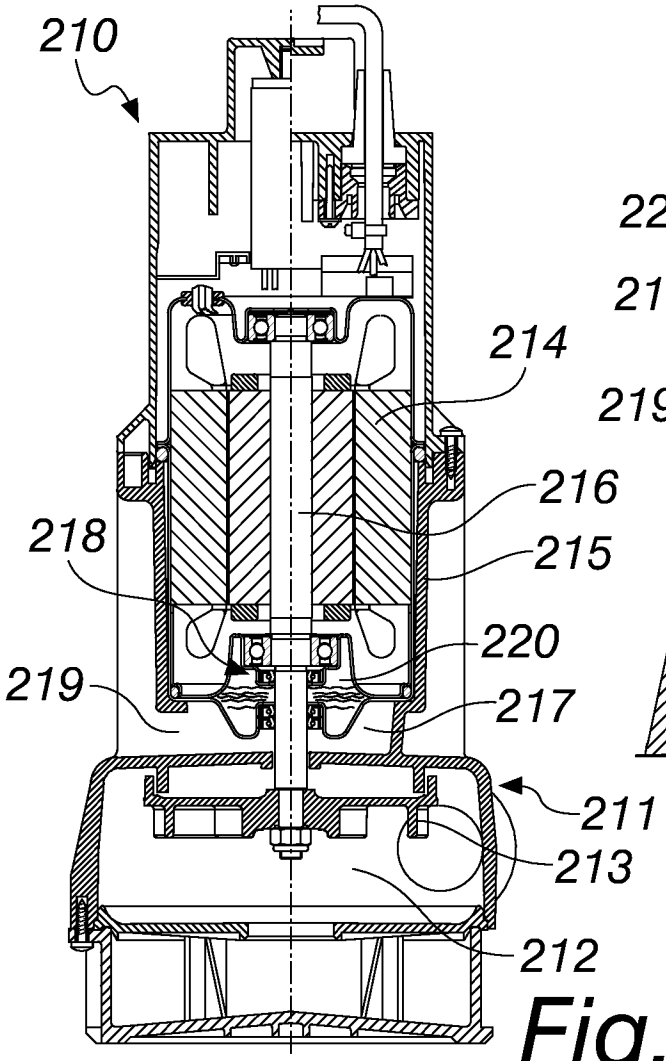
FIG. 5 is a sectional view of a third embodiment of the centrifugal pump according to the disclosure.

The third embodiment of a centrifugal pump according to the disclosure is shown in FIG. 5 and an enlarged-scale portion thereof is shown in FIG. 6.

Said pump is generally designated by the reference numeral 210 and comprises a hydraulic part 211 with a hollow body 212 inside which there are an impeller 213 and a motor 214, which is enclosed within a motor casing 215 that isolates it from the pumping liquid and is adapted to turn the impeller 213 by means of a rotation transmission shaft 216, on which the impeller 213 is keyed.

As in the preceding embodiments, the centrifugal pump 210 comprises an open compartment 217, which spaces the motor casing 215 from the hollow body 212 that contains the impeller 213, and hydraulic sealing means 218 between the open compartment 217 and the motor casing 215.

In this case the opening 219 of the open compartment 217 is present only at one side thereof.

The hydraulic sealing means here comprise the sealing chamber 220 interposed between the open compartment 217 and the motor 214 and three sealing rings 222, one of which is installed between the sealing chamber 220 and the motor 214, adjacent to the bearing 225, and two of which are installed in series between the open compartment 217 and the sealing chamber 220.

Figure 8:
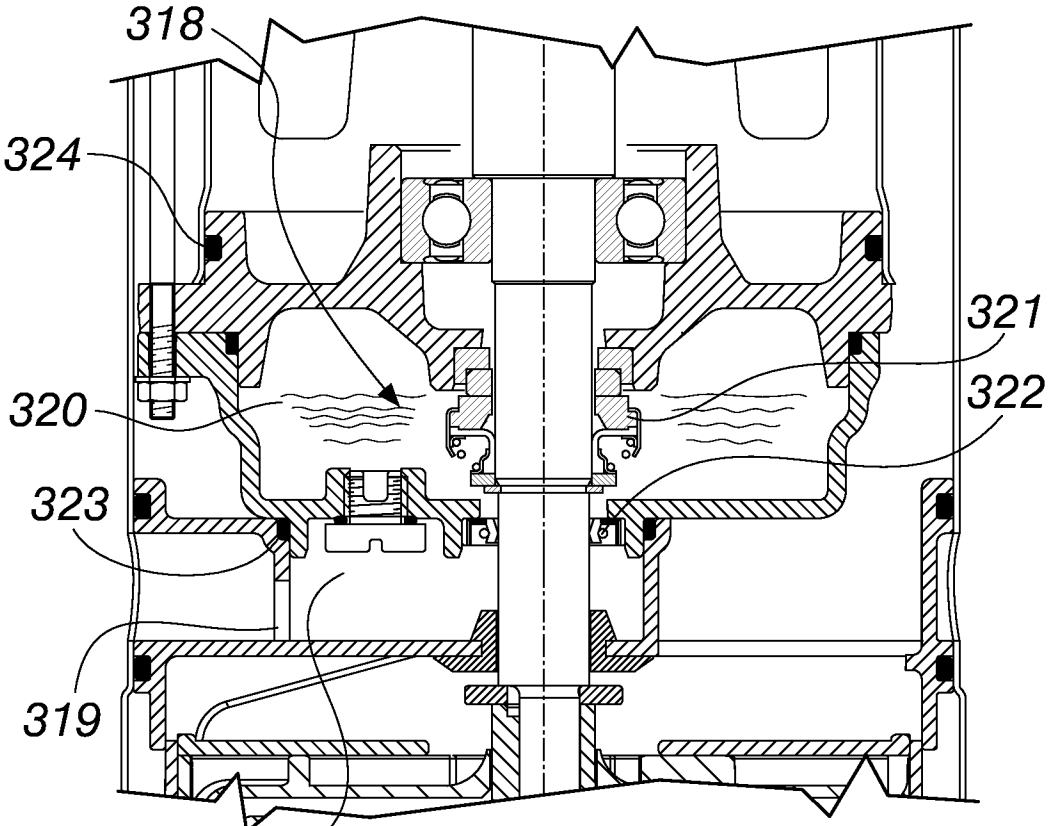
FIG. 8 is an enlarged-scale view of the centrifugal pump of FIG. 7.
Figure 7:
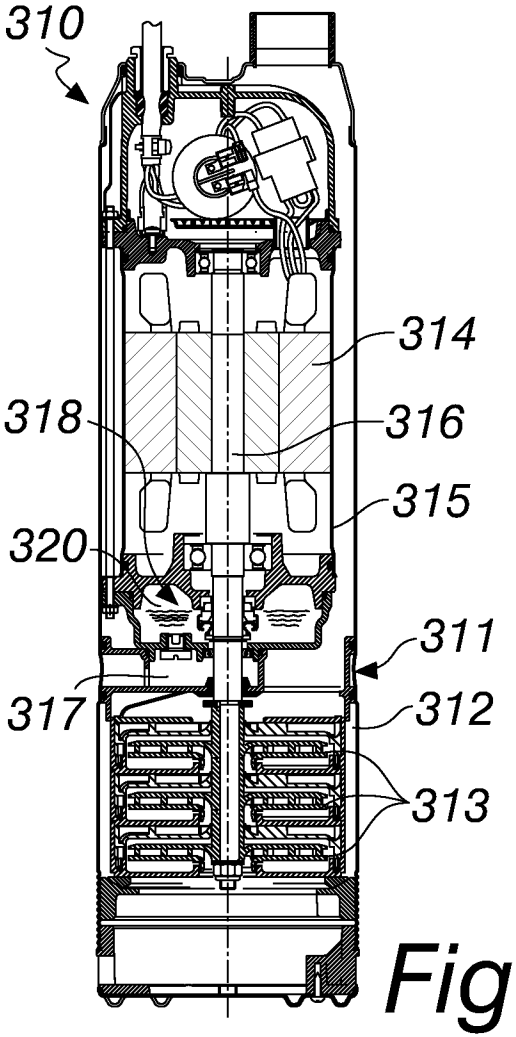
FIG. 7 is a sectional view of a fourth embodiment of the centrifugal pump according to the disclosure.

The fourth embodiment is shown in FIG. 7, in which the centrifugal pump is generally designated by the reference numeral 310, and a portion thereof is shown in enlarged scale in the following FIG. 8.

In this case this is a centrifugal pump, of the multistage submersed type.

The centrifugal pump 310 comprises a hydraulic part 311, with a hollow body 312 inside which there are three impellers 313 intercalated by diffusers, and a motor 314, which is enclosed within a motor casing 315 that isolates it from the pumping liquid and is adapted to turn the impellers 313 by means of a rotation transmission shaft 316 on which they are keyed.

Differently from the other embodiments, the delivery of the pump body is arranged in the upper part; therefore the pumped liquid, by passing through the pumping device lengthwise, skims laterally the motor casing 315.

Advantageously, the centrifugal pump 310 also comprises an open compartment 317, with a lateral opening 319, which spaces the motor casing 315 from the hollow body 312 that contains the impellers 313 and comprises to hydraulic sealing means 318 between the open compartment 317 and the motor casing 315.

In particular, the hydraulic sealing means 318 comprise a sealing chamber 320, interposed between the open compartment 317 and the motor casing 315, with a mechanical seal 321 inside it, and also comprise a sealing ring 322. Both the mechanical seal 321 and the sealing ring 322 are conveniently installed on the rotation transmission shaft 316 so as to surround it.

In particular, the mechanical seal 321 is installed on the motor side inside the sealing chamber 320, while the sealing ring 322 is installed outside the sealing chamber 320, between the latter and the open compartment 317.

The seal is also ensured by a first O-ring gasket 323 and by a second O-ring gasket 324, which isolate the external structure of the sealing chamber 320 respectively on the hydraulic side and on the motor side.

Figure 10:
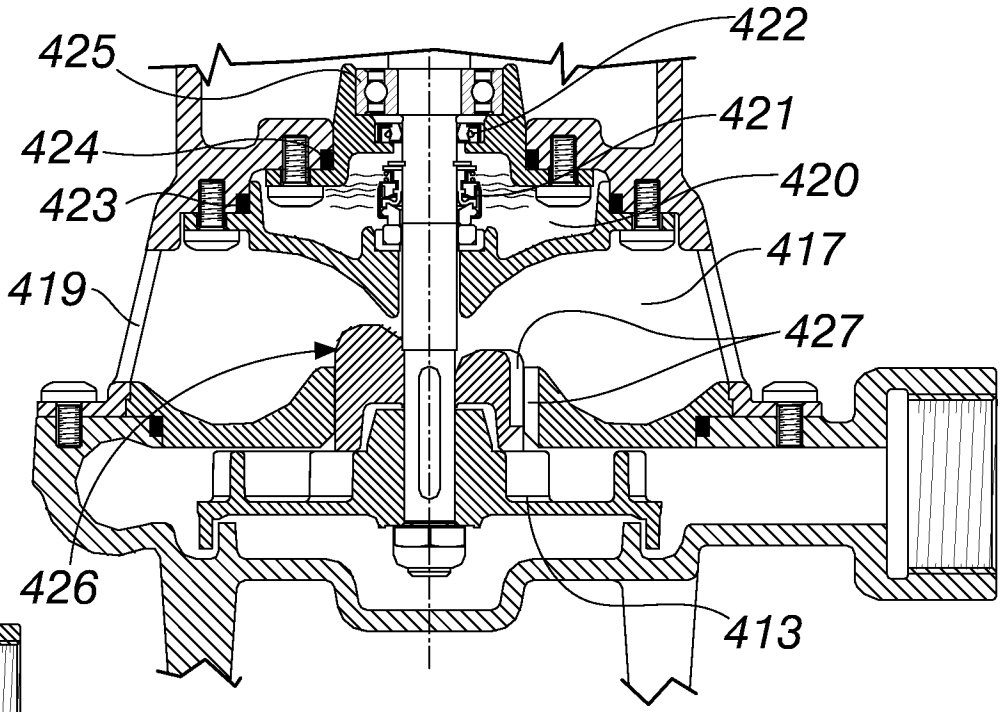
FIG. 10 is an enlarged-scale view of the centrifugal pump of FIG. 9.
Figure 9:
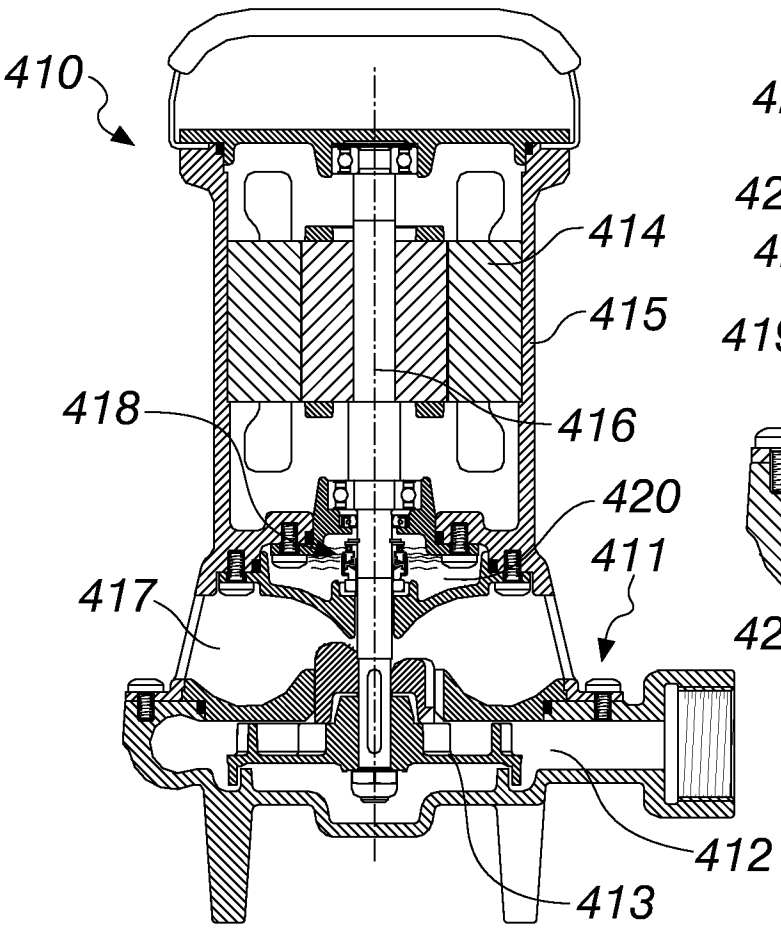
FIG. 9 is a sectional view of a fifth embodiment of the centrifugal pump according to the disclosure.

The fifth embodiment of the centrifugal pump according to the disclosure is shown in FIGS. 9 and 10. It is generally designated by the reference numeral 410.

The centrifugal pump is of the submersible type that can be used for lifting wastewater to be shredded, conveniently provided with a shredder 426.

In particular, it can be noted that it comprises a hydraulic part 411, with a hollow body 412 inside which there is an impeller 413, and a motor 414, enclosed within a motor casing 415 that isolates it from the pumping liquid and adapted to turn the impeller 413 by means of a rotation transmission shaft 416.

This pump also, like the previous ones, comprises an open compartment 417 that spaces the motor casing 415 from the hollow body 412 that contains the impeller 413 and hydraulic sealing means 418 between the open compartment 417 and the motor casing 415. The open compartment 417 has lateral openings 419, shown in the enlarged-scale view of FIG. 10.

The shredder 426, with rotating blades 427, is advantageously installed inside the open compartment 417 and is keyed on the rotation transmission shaft 416. The blades 427 are arranged on the outside diameter of the shredder 426.

The mechanical sealing means 418 comprise, as clearly visible in the enlarged-scale view of FIG. 10, a sealing chamber 420, which is interposed between the open compartment 417 and the motor casing 415 and inside which there is a mechanical seal 421, and comprise a sealing ring 422. The mechanical seal 421 and the sealing ring 422 are conveniently installed on the rotation transmission shaft 416 so as to surround it.

In particular, the mechanical seal 421 is installed on the hydraulic side inside the sealing chamber 420, while the sealing ring 422 is installed outside the sealing chamber 420, on the motor side, substantially between the latter and the motor 414, before the bearing 425.

There are also a first O-ring gasket 423 and a second O-ring gasket 424, which isolate the external structure of the sealing chamber 420 respectively on the hydraulic side and on the motor side.

Figure 12:
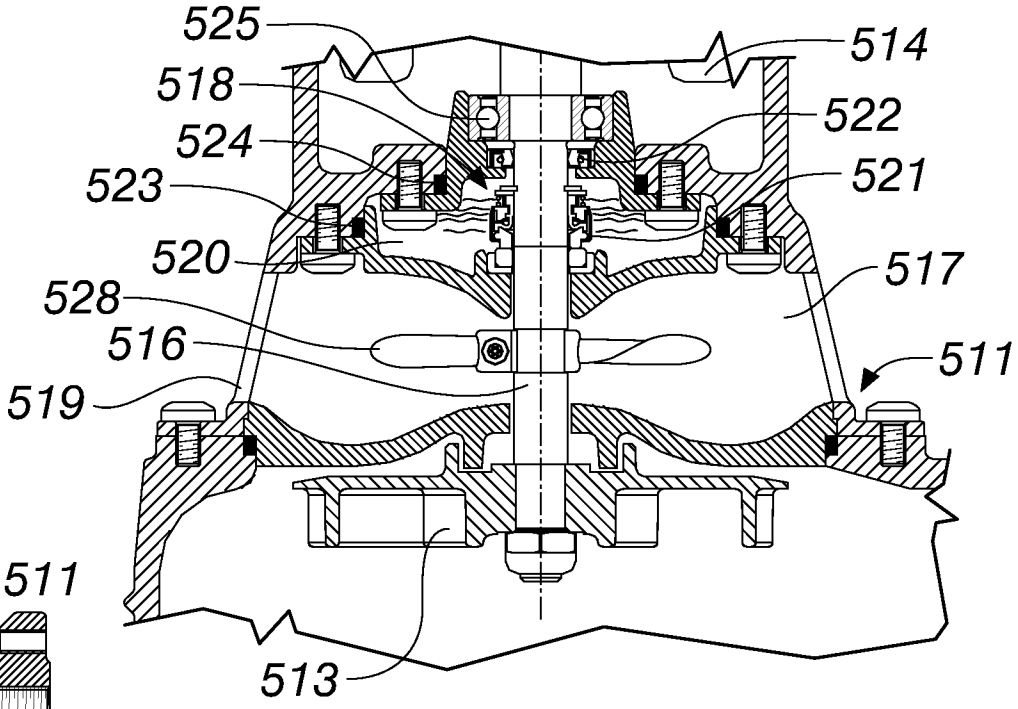
FIG. 12 is an enlarged-scale view of the centrifugal pump of FIG. 11.
Figure 11:
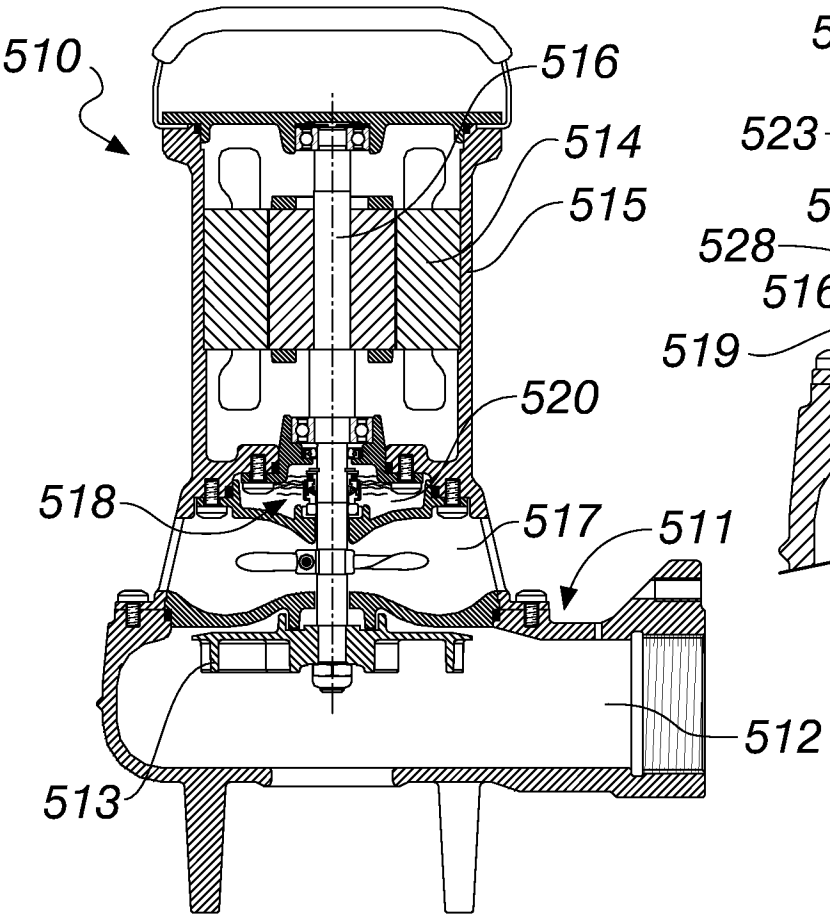
FIG. 11 is a sectional view of a sixth embodiment of the centrifugal pump according to the disclosure.

The sixth embodiment is shown in FIG. 11 and in an enlarged part thereof in FIG. 12 and is generally designated by the reference numeral 510.

The pump is of the vortex type and the structure comprises a hydraulic part 511 with a hollow body 512 that is open from below, where the suction of the pump is located, and containing an impeller 513 that is driven at pump power-on by a motor 514, enclosed within a motor casing 515 that isolates it from the pumping liquid and adapted to turn the impeller 513 by means of a rotation transmission shaft 516.

The centrifugal pump 510 comprises also an open compartment 517, which spaces the motor casing 515 from the hollow body 512 that contains the impeller 513, and hydraulic sealing means 518 between the open compartment 517 and the motor casing 515.

A liquid sealing chamber 520 separates the motor 514 from the hydraulic part 511, which also comprises an open compartment 517 interposed between the hollow body 512 and the sealing chamber 520 and provided with openings 519 that are lateral with respect to the illustrated sectional view.

Advantageously, the centrifugal pump 510 comprises, inside the open compartment 517, a fluid mixing screw 528 keyed on the rotation transmission shaft 516.

As in other embodiments, the hydraulic sealing means 518 comprise a sealing chamber 520, which is interposed between the open compartment 517 and the motor casing 515, internally containing a mechanical seal 521 and a sealing ring 522. Both the mechanical seal 521 and the sealing ring 522 are conveniently installed on the rotation transmission shaft 516 so as to surround it.

In particular, the mechanical seal 521 is installed inside the sealing chamber 520 and on the hydraulic side, while the sealing ring 522 is installed outside the sealing chamber 520, on the motor side and proximate to the bearing 525, substantially between the sealing chamber 520 and the motor 514.

In this case also there are a first O-ring gasket 523 and a second O-ring gasket 524, which isolate the external structure of the sealing chamber 520 respectively on the hydraulic side and on the motor side.

As can be seen in FIGS. 9 to 12, the open compartment 417 and 517 is of a greater height than the compartment of the preceding embodiments, in order to allow the installation, respectively, of the shredder 426 and of the mixing screw 528.

Figures 13, 14:
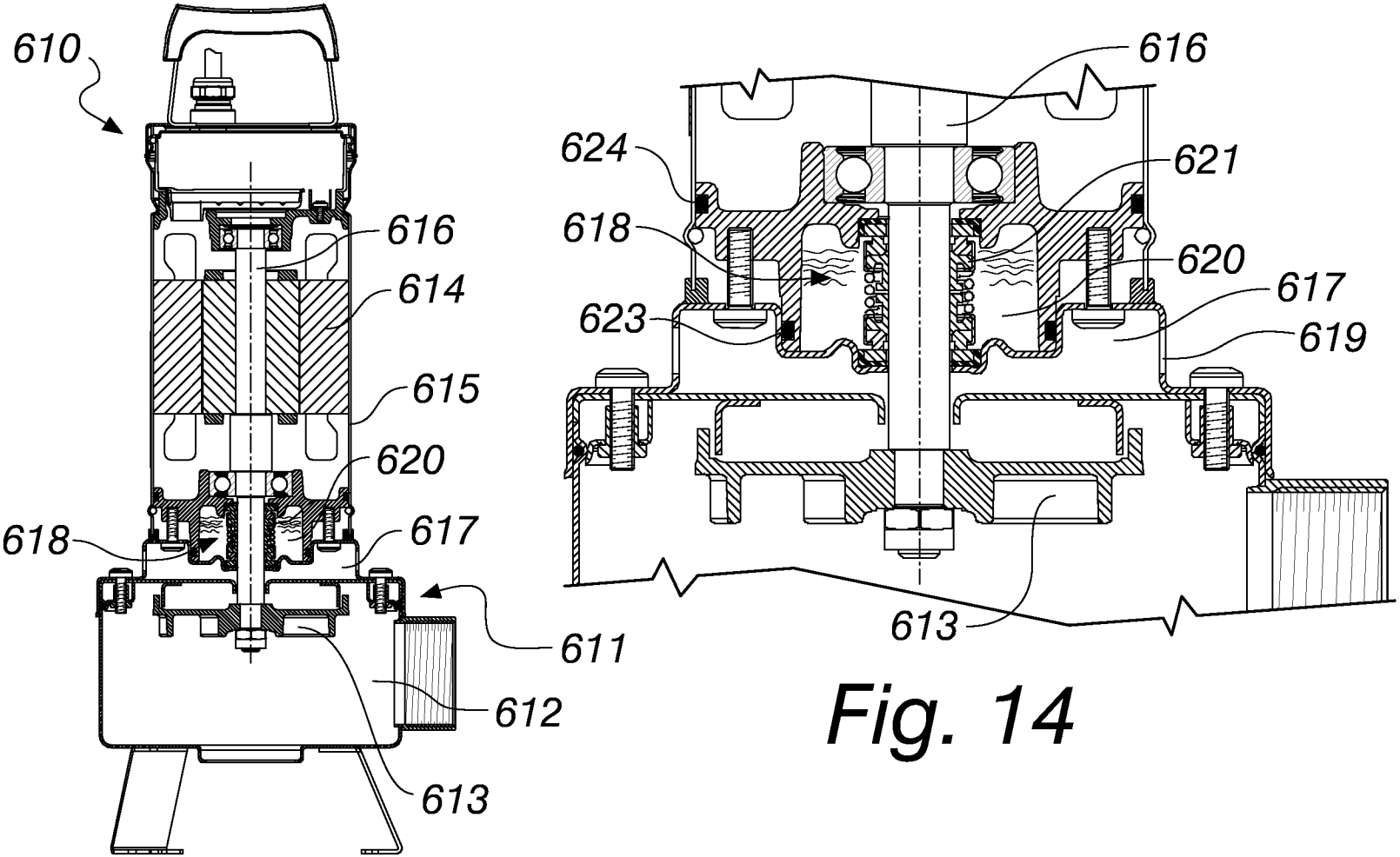
FIG. 13 is a sectional view of a seventh embodiment of the centrifugal pump according to the disclosure.
FIG. 14 is an enlarged-scale view of the centrifugal pump of FIG. 13.

FIG. 13 and FIG. 14 show a seventh embodiment of the centrifugal pump according to the disclosure, generally designated by the reference numeral 610.

The pump is of the submersible type, like the one shown and described for the first embodiment, and like the latter said pump comprises a hydraulic part 611, with a hollow body 612 inside which there is an impeller 613, a to motor 614, enclosed within a motor casing 615 that isolates it from the pumping liquid and adapted to turn the impeller 613 by means of a rotation transmission shaft 616 that substantially passes through the centrifugal pump 610 lengthwise, connecting the hydraulic part 611 to the motor 614.

The centrifugal pump 610 comprises also an open compartment 617 that spaces the motor casing 615 from the hollow body 612 that contains the impeller 613 and hydraulic sealing means 618 between the open compartment 617 and the motor casing 615. In the figures, the centrifugal pump 610 is cross-sectioned at the lateral openings 619 of the open compartment 617, referenced in the enlarged-scale view of FIG. 14.

The hydraulic sealing means 618 comprise in this case a sealing chamber 620, interposed between the open compartment 617 and the motor casing 615, with a double mechanical seal 621 inside it, conveniently installed on the rotation transmission shaft 616 so as to surround it.

This seventh embodiment differs from the preceding ones in the type of hydraulic sealing means 618, with double mechanical seal 621, and although this solution has been described only for this last illustrated centrifugal pump it may be applied also to other pumps, replacing their sealing means.

As in other cases described previously, the seal is also ensured by a first O-ring gasket 623 and by a second O-ring gasket 624, which isolate the external structure of the sealing chamber 620 respectively on the hydraulic side and on the motor side.

Operation of the centrifugal hydraulic pump according to the disclosure is as follows.

In general, for all the embodiments of the centrifugal pump, the open compartment 17 interposed between the motor 14 and the hollow body 12 (references to the other embodiments are omitted here for the sake of practicality) constitutes a region at a pressure that is lower than the hydraulic pressure that is present in the hollow body 12 during the operation of the pump.

The open compartment 17 is connected to the tank or trap from which the liquid to be pumped is drawn and therefore the pressure inside it is substantially equal to the geodetic pressure, i.e., the submersibility pressure of the product.

In this manner, during the operation of the centrifugal pump the motor 14 is not subjected to the hydraulic pressure imposed by the pumping of the liquid inside the hollow body 12, but to the hydraulic pressure of the tank or trap from which the liquid being drawn is collected and the optional liquid that leaks from the hollow body 12 that contains the impeller 13 (or the impellers in the case of a multistage pump) rises to the open compartment 17, in which due to the pressure, which is lower than the pressure of origin, conditions such that the liquid can rise further to reach the dry part of the motor 14 do not occur.

Substantially, the pressure generated by the hydraulics of the centrifugal pump does not affect the seal of the motor.

In the case of the centrifugal pump 410, at power-on the shredder 426 also is activated and shreds the solid bodies in the open compartment 417, which is connected to the tank from which the liquid to be pumped is drawn. The intake is in fact conveniently arranged upward with respect to the hollow body 412, so that shredding of the solid bodies in the liquid that is drawn is ensured.

The fact that the shredder 426 is substantially upside down in the open compartment 417, with respect to the background art, allows to reduce its distance from the motor 414 and therefore from the bearing 425, limiting vibrations, caused by the passage of the solid bodies between the blades 427, on the bearings 425, on the motor 414 and also on the mechanical seal 421.

In this manner the functionality of the motor and the mechanical seal is preserved, maintaining the alignment of the parts that compose it.

The sixth embodiment also ensures the hydraulic seal in the manner explained for all the embodiments and at the same time moves the fluid in the trap while preventing any sediments from being deposited on the bottom.

In practice it has been found that the disclosure achieves the advantages by providing a centrifugal pump, of the submersed or submersible type, capable of ensuring over time the hydraulic seal between the liquid pumping region and the dry region of the motor at the shaft for transmitting rotation to the impellers, preventing any fluid leakages from reaching the motor.

In this manner a longer life of the centrifugal pump is advantageously ensured.

Moreover, the centrifugal pump is structurally simple and can be manufactured at low costs.

Another advantage of the centrifugal pump according to the disclosure is the possibility to install a shredder or a mixing screw inside the open compartment simply by increasing the height that spaces the motor from the hollow body that contains the impeller or impellers.

In this manner it is possible at the same time to further increase the lifespan of the product provided with a shredder, by way of the reduction of the vibrations that can be transmitted to the motor and to the mechanical seal and it is possible to obtain the movement of the liquid to be drawn, without having to install additional devices, such as the agitator, upstream of the pump.

The disclosure thus conceived is susceptible of numerous modifications and variations; all the details may further be replaced with other technically equivalent elements.

In practice, the materials used, so long as they are compatible with the specific use, as well as the contingent shapes and dimensions, may be any according to requirements and to the state of the art.

The invention claimed is:

1. A centrifugal pump comprising: a hydraulic part, with a hollow body inside which there is at least one impeller, a motor enclosed within a motor casing defining a motor chamber that isolates said motor from the pumping liquid, adapted to drive said impeller in rotation by means of a rotation transmission shaft, wherein said centrifugal pump comprises an open compartment that spaces said motor casing from said hollow body that contains said at least one impeller and hydraulic sealing means between said open compartment and said motor casing, said hydraulic sealing means comprising an isolated and sealed sealing chamber being fluid-tight.

2. The centrifugal pump according to claim 1, wherein said hydraulic sealing means comprise a sealing chamber interposed between said open compartment and said motor casing, with a mechanical seal inside said sealing chamber, and comprise a sealing ring, said mechanical seal and said sealing ring being installed on said rotation transmission shaft so as to surround said rotation transmission shaft.

3. The centrifugal pump according to claim 1, wherein said hydraulic sealing means comprise a sealing chamber interposed between said open compartment and said motor and at least two sealing rings, of which at least one is installed between said sealing chamber and said motor, and at least one is installed between said open compartment and said sealing chamber.

4. The centrifugal pump according to claim 1, wherein said hydraulic sealing means comprise a sealing chamber, interposed between said open compartment and said motor casing, with a mechanical seal inside said sealing chamber installed on said rotation transmission shaft, surrounding it.

5. The centrifugal pump according to claim 1, further comprising a shredder keyed on said rotation transmission shaft inside said open compartment.

6. The centrifugal pump according to claim 1, further comprising a mixing screw for the liquid to be pumped which is keyed on said rotation transmission shaft inside said open compartment.

7. The centrifugal pump according to claim 2, wherein said sealing ring is installed between said open compartment and said sealing chamber.

8. The centrifugal pump according to claim 2, wherein said sealing ring is installed substantially between said sealing chamber and said motor.

9. The centrifugal pump according to claim 3, further comprising a pair of said sealing rings installed in series between said open compartment and said sealing chamber.

* * * * *